US006753514B2

(12) United States Patent
Harashima

(10) Patent No.: US 6,753,514 B2
(45) Date of Patent: Jun. 22, 2004

(54) SHEET MEMBER WITH HEATER WIRE, ELECTRIC POTENTIAL MAT, AND METHOD FOR FABRICATING SHEET MEMBER WITH HEATER WIRE

(75) Inventor: Toru Harashima, Osaka (JP)

(73) Assignee: Atex Co., Ltd., Osaka (JP)

( * ) Notice: Subject to any disclaimer, the term of this patent is extended or adjusted under 35 U.S.C. 154(b) by 0 days.

(21) Appl. No.: 10/279,905

(22) Filed: Oct. 25, 2002

(65) Prior Publication Data

US 2003/0080114 A1 May 1, 2003

(30) Foreign Application Priority Data

Oct. 25, 2001 (JP) ..... P2001-328106
Dec. 5, 2001 (JP) ..... P2001-371813

(51) Int. Cl.[7] ..... H05B 3/54

(52) U.S. Cl. ..... 219/529; 219/211; 219/212; 219/544; 219/549

(58) Field of Search ..... 219/529, 211, 219/212, 217, 528, 544, 545, 549, 542; 392/425, 432, 435

(56) References Cited

U.S. PATENT DOCUMENTS 3,114,825 A * 12/1963 Kilburn et al. ..... 219/549
3,739,142 A * 6/1973 Johns ..... 219/212
4,094,357 A * 6/1978 Sgroi ..... 219/212
4,625,394 A * 12/1986 Kemnitz et al. ..... 219/212
5,811,765 A * 9/1998 Nakagawa et al. ..... 219/212
5,986,243 A * 11/1999 Campf ..... 219/529
6,300,597 B1 * 10/2001 Lee ..... 219/212
6,310,332 B1 * 10/2001 Gerrard ..... 219/212
6,415,501 B1 * 7/2002 Schlesselman et al. ..... 219/529
6,501,055 B2 * 12/2002 Rock et al. ..... 219/545

* cited by examiner

*Primary Examiner*—Henry Bennett
*Assistant Examiner*—Fadi H. Dahbour
(74) *Attorney, Agent, or Firm*—Birch, Stewart, Kolasch & Birch, LLP

(57) ABSTRACT

A sheet member with a heater wire comprises a sheet-like base cloth and a cylindrical containing portion containing the heater wire therein and attached at one surface of the base cloth in a meandering shape.

10 Claims, 18 Drawing Sheets

Prior Art

SHEET MEMBER WITH HEATER WIRE, ELECTRIC POTENTIAL MAT, AND METHOD FOR FABRICATING SHEET MEMBER WITH HEATER WIRE

This nonprovisional application claims priority under 35 U.S.C. §119(a) on U.S. patent application Ser. No. 2001-328106 and 2001-371813 filed in JAPAN on Oct. 25, 2001 and Dec. 5, 2001, which is herein incorporated by reference.

BACKGROUND OF THE INVENTION

1. Field of the Invention

The present invention relates to a sheet member with a heater wire suitable for use in an electric blanket, an electric bed sheet, an electric potential mat or the like, an electric potential mat using the same, and a method for fabricating the sheet member with a heater wire.

2. Description of the Prior Art

A sheet member with a heater wire, in which a heater wire for generating heat is fixed to the sheet member in a meandering shape, is used in, for example, an electric blanket, an electric bed sheet, an electric potential mat or the like. There has been known a sheet member with a heater wire in which a heater wire b is contained inside a sheet member "a" obtained by superimposing two sheets of rectangular cloth members a1 and a2 one on another, as shown in, for example, FIG. 21. Each of the cloth members a1 and a2 includes a joint portion c, at which dotted portions are bonded or sewn to each other. Between the joint portions c and c is formed a wire passing portion d, into which the heater wire b is inserted. The heater wire b is positioned at a predetermined position by the use of the wire passing portion d.

However, since the two sheets of rectangular cloth members a1 and a2 are stuck to each other in the above-described sheet member with the heater wire, there arise problems of complicated structure, degraded productivity and a high material cost. Furthermore, in the prior art, there has been needed a work that the two sheets of rectangular cloth members a1 and a2 are stuck to each other in advance, thereby forming the sheet member "a", and then, the heater wire b is manually inserted into the wire passing portion d in sequence, resulting in poor productivity.

SUMMARY OF THE INVENTION

The present invention has been accomplished in an attempt to solve the above problems observed in the prior art. An object of the present invention is to provide a sheet member with a heater wire, in which the structure can be simplified and the productivity can be improved. Furthermore, another object of the present invention is to provide a method for fabricating the sheet member with a heater wire, in which the productivity can be improved. Moreover, a further object of the present invention is to provide an inexpensive electric potential mat by the use of the above-described sheet member with a heater wire.

According to a first aspect of the present invention, a sheet member with a heater wire comprising a sheet-like base cloth and a cylindrical containing portion containing the heater wire therein and attached at one surface of the base cloth in a meandering shape. Furthermore, it is desirable that the containing portion should be formed by folding a belt-shaped member in two along an axial line in its longitudinal direction so as to allow both side edges thereof to face to each other, and sewing the belt-shaped member in the vicinities of the side edges facing to each other integrally with the base cloth. Moreover, it is desirable that the base cloth should have a marking along the attaching position of the containing portion.

Additionally, it is desirable to constitute a electric potential mat using the sheet member with the heater wire and an electric potential generator for applying high voltage minus electric potential to human body insulated from the ground lying thereon. It is desirable that a mat body of the electric potential mat should be integrally provided with a controller section including an electric potential control circuit for controlling the electric potential generator and a switch for operating the electric potential control circuit so as to switch electric potential emission. The controller section may include a heater control circuit capable of controlling the heat generation by the heater wire, and a switch for operating the heater control circuit.

According to an another aspect of the present invention, a method for fabricating a sheet member with a heater wire comprises the steps of continuously supplying a containing member containing therein the heater wire and sewing the supplied containing member to one surface of a sheet-like base cloth in a meandering shape. Furthermore, it is desirable that the containing member should contain a heater wire therein by folding a belt-shaped member in two along an axial line in its longitudinal direction. Moreover, it is desirable that the containing member should be continuously supplied in the supplying step by using a containing jig having a belt-shaped member folding guide for folding the belt-shaped member in two as the belt-shaped member passes and a heater wire guide for guiding the heater wire in such a manner that the heater wire can be contained in the belt-shaped member folded in two. Additionally, it is desirable that the sewing step should be carried out by a sewing machine having a pressing metal fitting for pressing between a sewing section for sewing the containing member to the base cloth and the heater wire contained in the containing member, so as to prevent movement of the heater wire toward the sewing section. In addition, it is desirable that the containing member should be sewn in accordance with a marking previously formed at a containing member attaching position of the base cloth in the sewing step.

DETAILED DESCRIPTION OF THE PREFERRED EMBODIMENT

A preferred embodiment of a sheet member with a heater wire together with a method for fabricating the same according to the present invention will be described below in reference to the accompanying drawings.

In FIGS. 1 to 4, in the sheet member 1 with a heater wire, a heater wire 3 capable of generating heat comprises a sheet-like base cloth 2 and a cylindrical containing portion 4 containing the heater wire 3 therein and attached at one surface 2*a* of the base cloth 2 in a meandering shape. The sheet member 1 is covered with, for example, a quilting mat or the like, and then, assembled in a final product such as an electric blanket, an electric bed sheet or an electric potential mat, to be thus used as a heat generator for warming human body, as described later in detail.

It is preferable that a material having such flexibility as to be deformably folded should be used as the base cloth 2. Specifically, a fiber material, a mat, a non-woven fabric, a resin sheet and the like are preferable. There is illustrated one example in which the base cloth 2 in the present embodiment is formed of one sheet of thin non-woven fabric having a width of 100 cm, a length of 200 cm and a thickness of 0.5 mm to 1 mm. Here, the shape, thickness, material and the like of the base cloth 2 may be variously changed according to the application of the sheet member 1 with the heater wire. Various kinds of heater wires can be used as long as the heater wire 3 can generate heat by energization. In the present embodiment, there is used a resin covered heater wire including a heat generating wire 3*a* made of alloy, for example, including Ni, Cr and Fe, or the like and a resin cover 3*b* for covering the heat generating wire 3*a*.

Furthermore, in the sheet member 1 with the heater wire, the cylindrical containing portion 4 is attached to one surface 2*a* of the base cloth 2 in a meandering shape. The heater wire 3 is contained in the containing portion 4.

Figure 5:
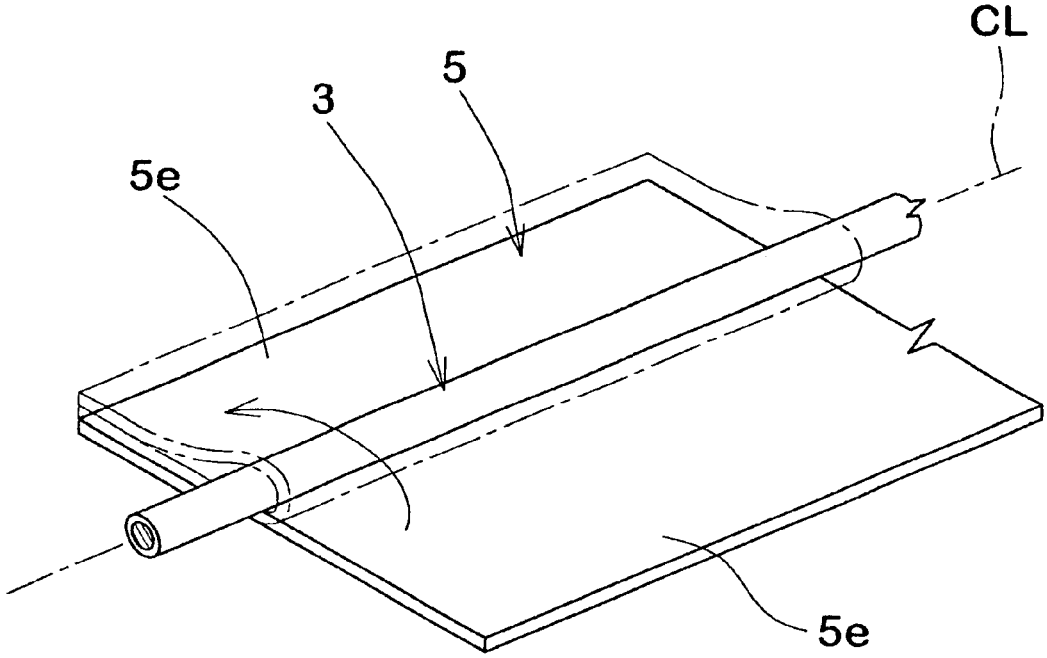
FIG. 5 is a partial perspective view showing one example of a containing portion.
Figure 21:
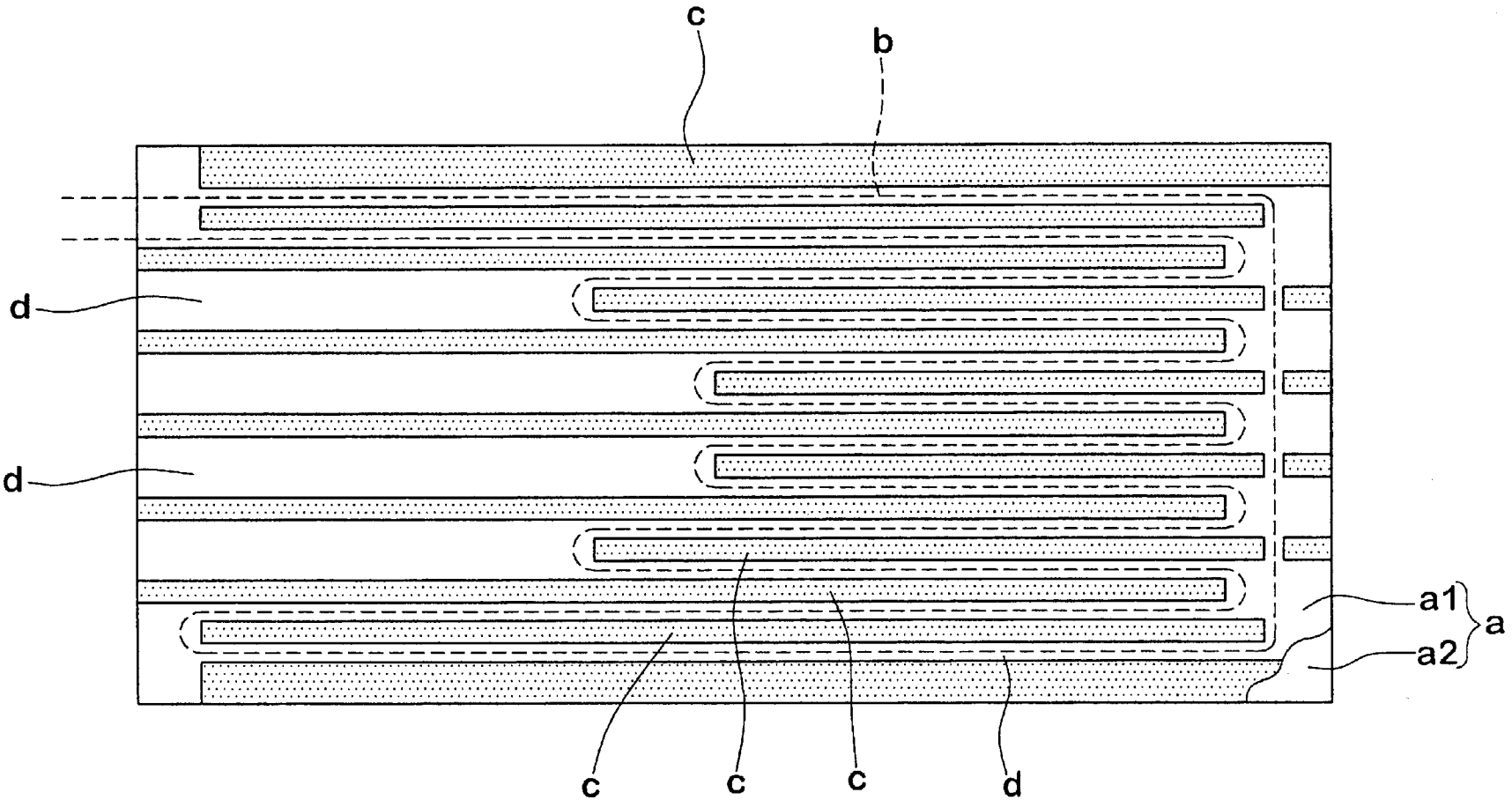
FIG. 21 is a perspective view showing a sheet member with a heater wire in the prior art.

As shown in FIG. 5, in the present embodiment, the containing portion 4 is configured such that an elongated belt-shaped member 5 is folded in two along an axial line CL in a longitudinal direction of the belt-shaped member 5, so that both of side edges 5*e* and 5*e* face to each other, to be then sewn integrally with the base cloth 2 via a thread Q in the vicinities of the side edges 5*e* and 5*e*. Moreover, the containing portion 4 contains the heater wire 3 in a space defined inside thereof. Consequently, the heater wire 3 is fixed at a predetermined position with respect to the base cloth 2. The sheet member 1 with the heater wire having the above-described configuration is simpler in structure and less in material to be used than that shown in FIG. 21, thus achieving high productivity, weight reduction and cost reduction.

Figure 3:
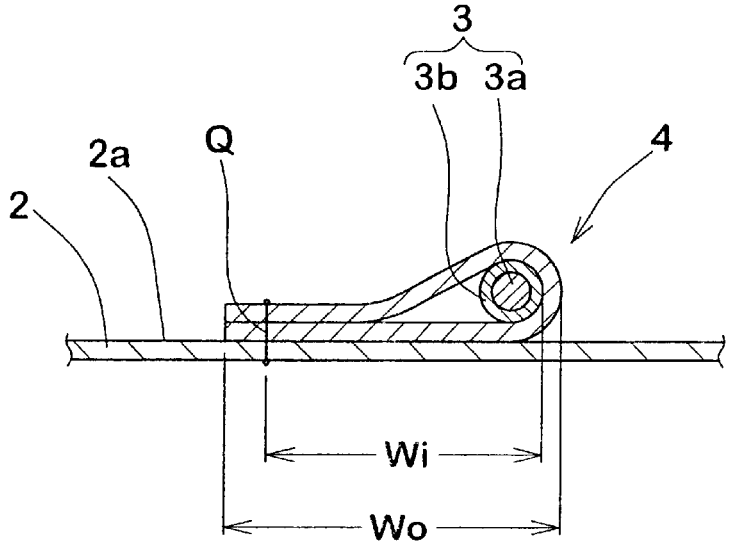
FIG. 3 is a cross-sectional view showing the sheet member with a heater wire, taken along a line A—A in FIG. 2.
Figure 4:
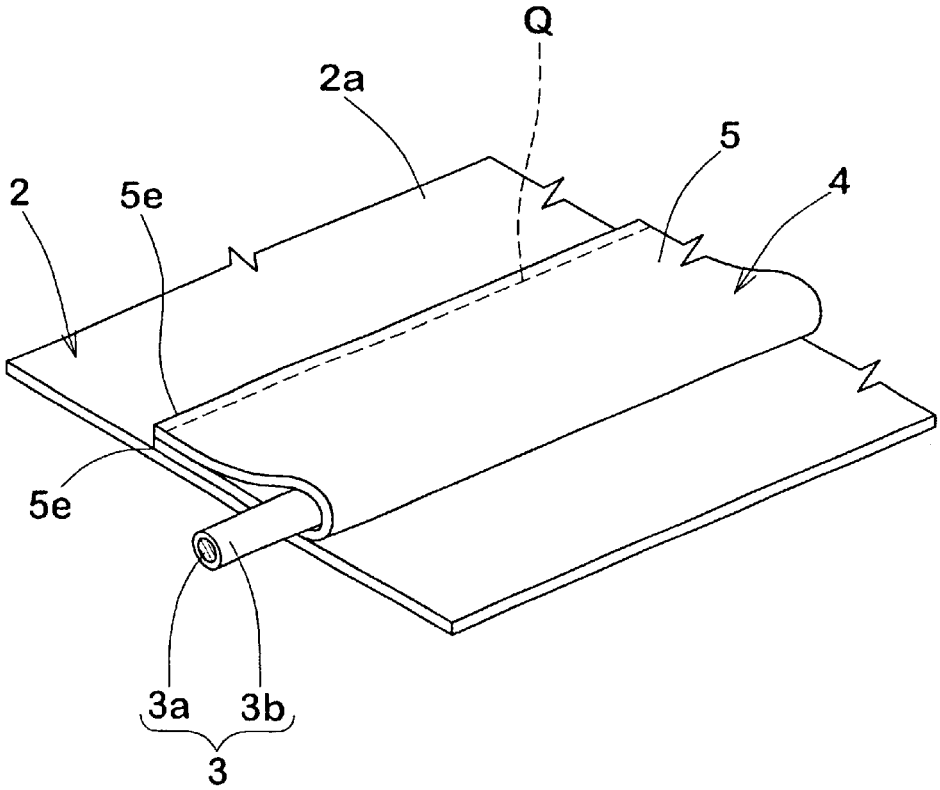
FIG. 4 is a perspective view showing the sheet member with a heater wire shown in FIG. 3.

Additionally, as shown in FIG. 3, it is possible to prevent the heater wire 3 from being largely mis-aligned with respect to the base cloth 2 by adjusting a containing width Wi or the like of the inside of the containing portion 4. Although not particularly limited, the containing width Wi is preferably, for example, 3 mm to 15 mm. If the containing width Wi is smaller than 3 mm, the moving width of the heater wire 3 tends to become small. On the contrary, if the containing width Wi exceeds 15 mm, a waste of a material cost is liable to be induced. Moreover, the width Wo of the containing portion 4 is, for example, about 4 to 10 times, more preferably, about 4 to 8 times the diameter of the heater wire 3, although not particularly limited. In this manner, it is possible to reduce the material cost.

The belt-shaped member 5 in the present embodiment is exemplified in a member made of a long tape-like non-woven fabric having a small width. As long as the belt-shaped member 5 is so hard as to be freely folded and is resistant to the heat generation of the heater wire 3, the belt-shaped member 5 can be made of various kinds of materials other than the non-woven fabric. In the present embodiment, the diameter of the heater wire 3 is about 2 mm, and further, the width of the belt-shaped member 5 before being folded is about 25 mm.

Figure 1:
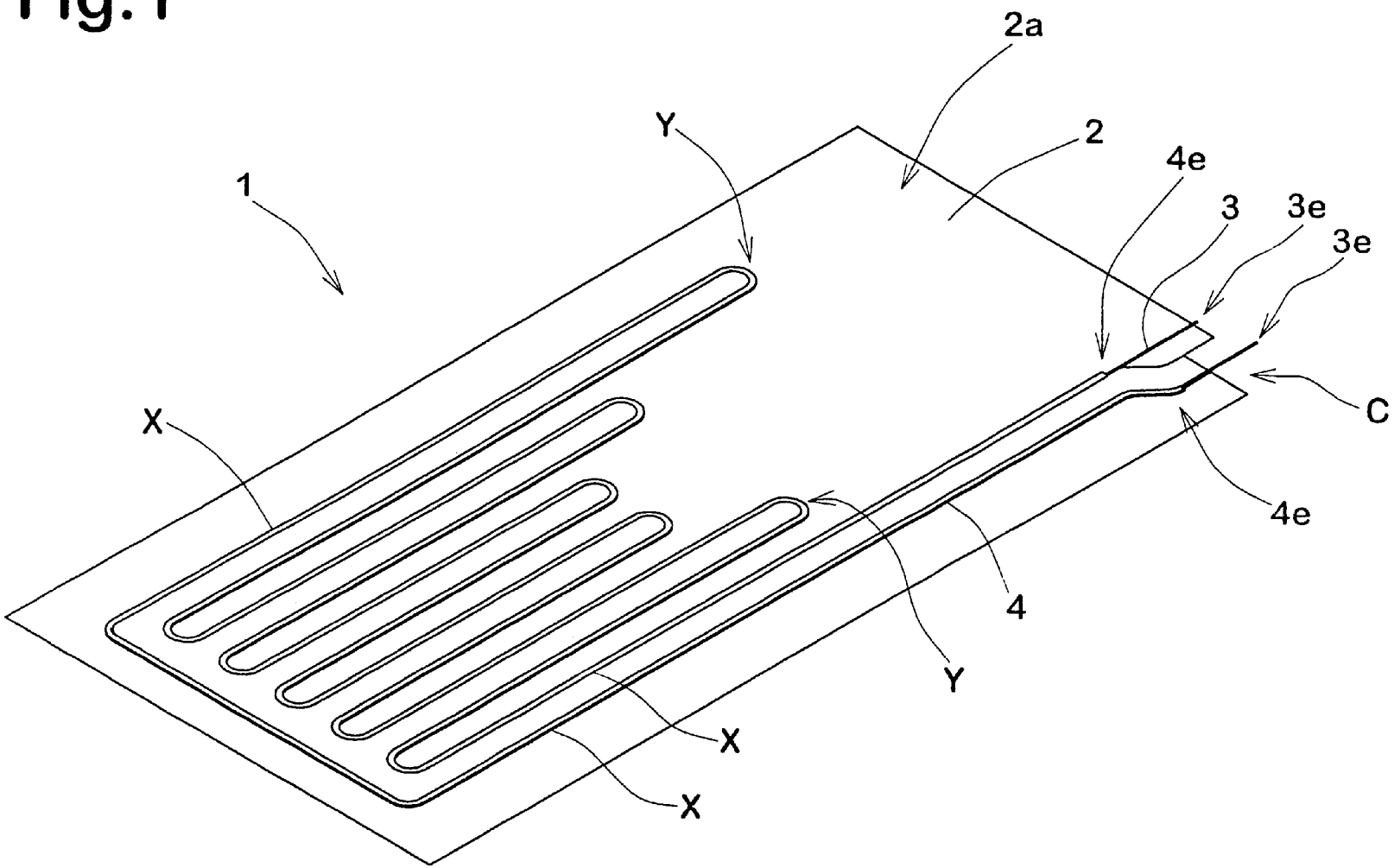
FIG. 1 is a perspective view showing a sheet member with a heater wire in one preferred embodiment according to the present invention.
Figure 2:
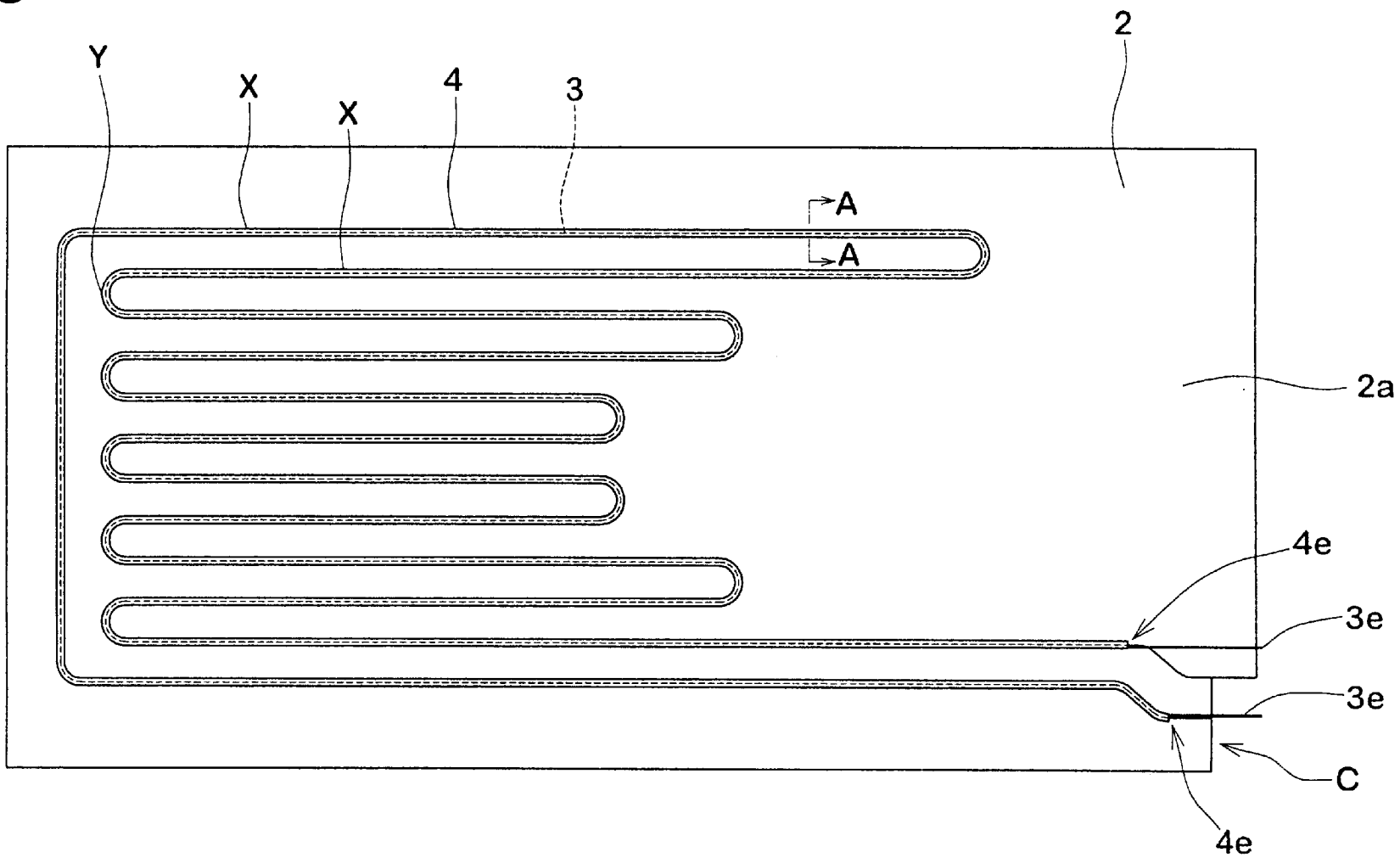
FIG. 2 is a plan view showing the sheet member with a heater wire in the preferred embodiment according to the present invention.

As shown in FIGS. 1 and 2, the containing portion 4 is continuously arranged over a wide range of one surface 2*a* of the base cloth 2 in a meandering shape by appropriately combining straight portions X and arcuate portions Y with each other. As a consequence, the heater wire 3 can be efficiently disposed over a wide range. Furthermore, it is possible to prevent excessive bending of the heater wire 3, thereby avoiding any degradation of durability. Here, both ends 4*e* and 4*e* of the containing portion 4 are terminated in the vicinity of a corner portion C of the base cloth 2 in the present embodiment. Ends 3*e* and 3*e* of the heater wire 3 project to the corner portion C from the ends 4*e* and 4*e* of the containing portion 4. At the corner portion C, the ends 3*e* of the heater wire 3 can be easily connected to a substrate of a controller, not shown, or the like. Incidentally, the layout of the containing portion 4 is not restricted to the illustration, and can be appropriately changed.

Sewing is suitable for attaching the containing portion 4 to the base cloth 2. Otherwise, the containing portion 4 may be secured to the base cloth 2 by thermally welding or using an adhesive, a staple, a button, a hook and loop fastener or the like. Although it is sufficient that the containing portion 4 is formed at one surface 2*a* of the base cloth 2, another containing portion 4 may be additionally formed at the other surface of the base cloth 2.

Figure 6A:
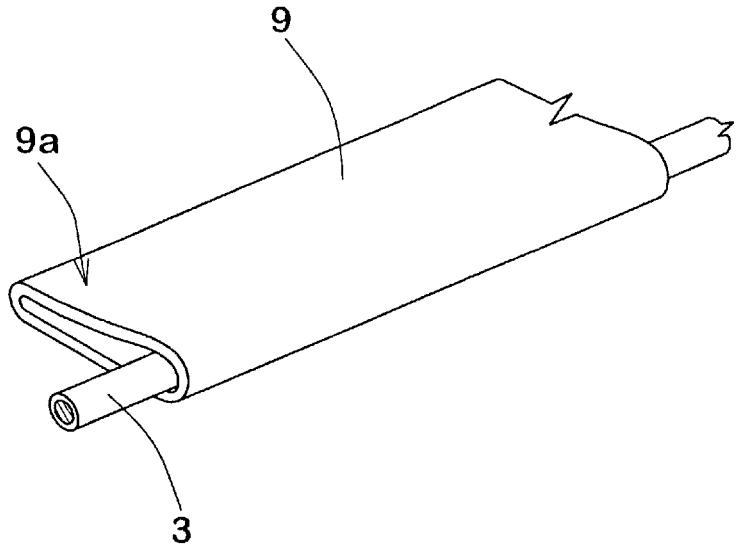
FIGS. 6A and 6B are perspective views showing another example of the containing portion.
Figure 6B:
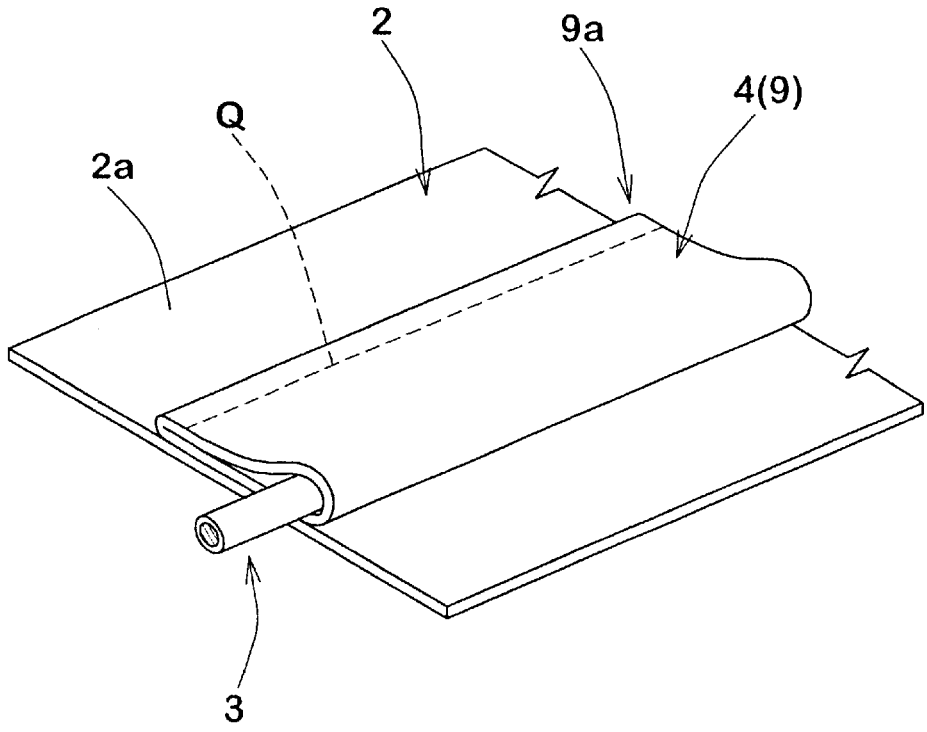

FIGS. 6A and 6B show the containing portion 4 in another example. In this example, the containing portion 4 may be formed by attaching a tubular member 9 having a previously closed cross-section, as shown in FIG. 6A, to the base cloth 2. Although one edge 9*a* of the tubular member 9 is fixed to the base cloth 2 via a thread Q in this example, other fixing methods may be adopted.

Figure 7:
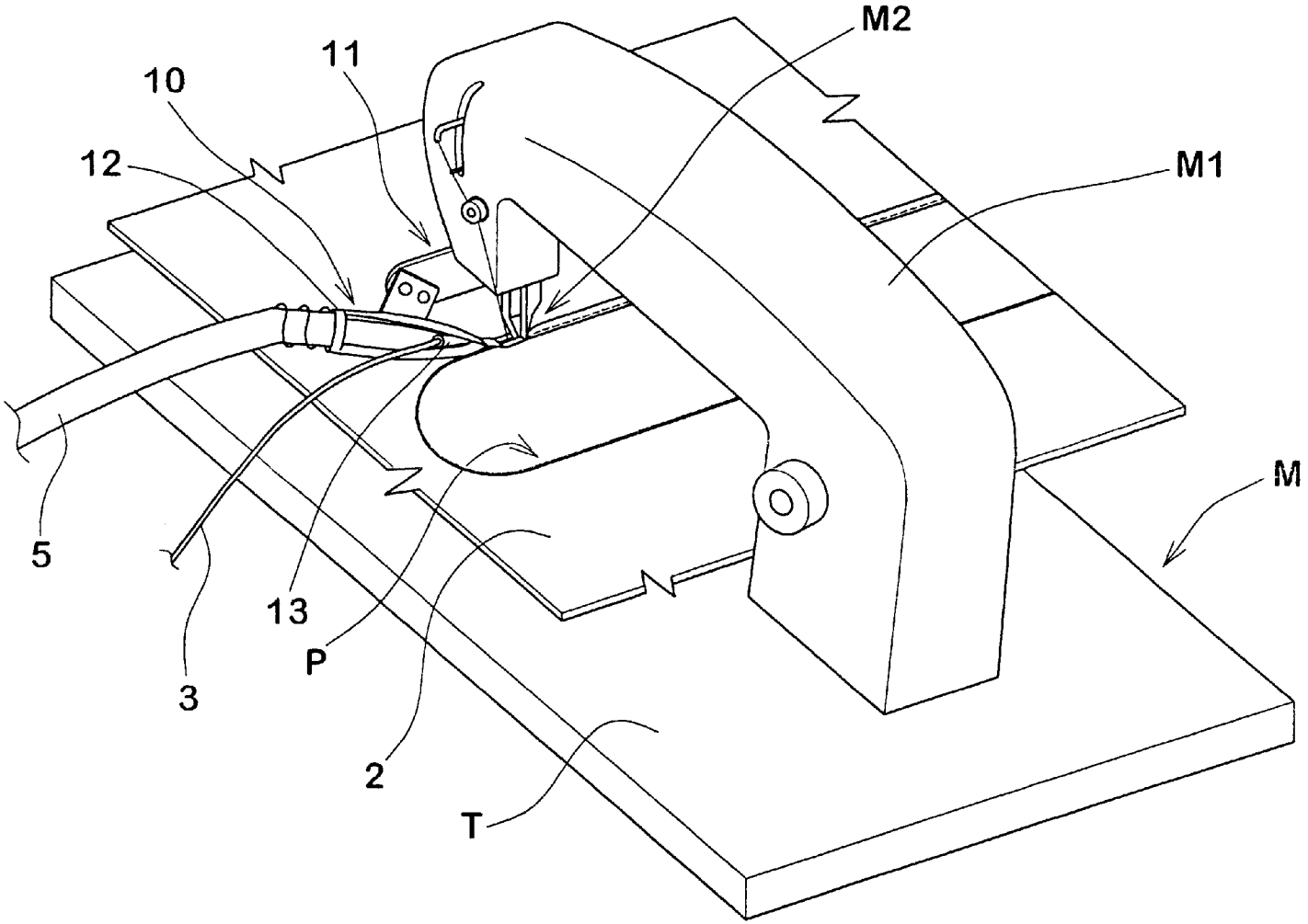
FIG. 7 is a general perspective view showing one example of a method for fabricating the sheet member with a heater wire.
Figure 8:
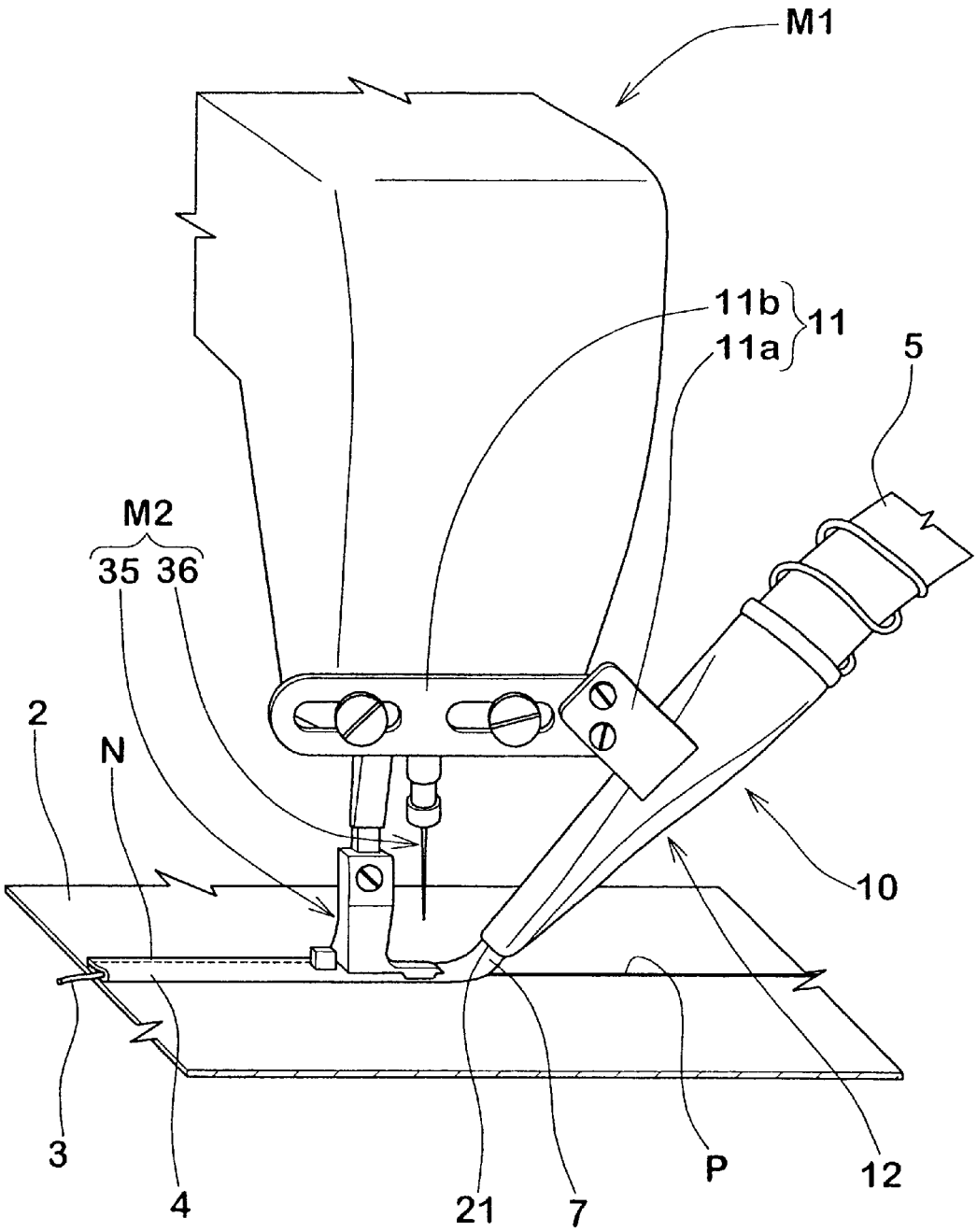
FIG. 8 is a partial enlarged perspective view showing the method for fabricating the sheet member with a heater wire.

Subsequently, explanation will be made below on one example of a preferred method for fabricating the above-described sheet member 1 with the heater wire. FIGS. 7 and 8 illustrate one example of the fabricating method using a sewing machine. In this example, the sheet member 1 with the heater wire is fabricated by the step of continuously supplying a containing member 7 consisting of the heater wire 3 and the belt-shaped member 5 containing the heater wire 3 therein and the step of sewing the supplied containing member 7 to one surface 2*a* of the base cloth 2 in a meandering shape.

Figure 9:
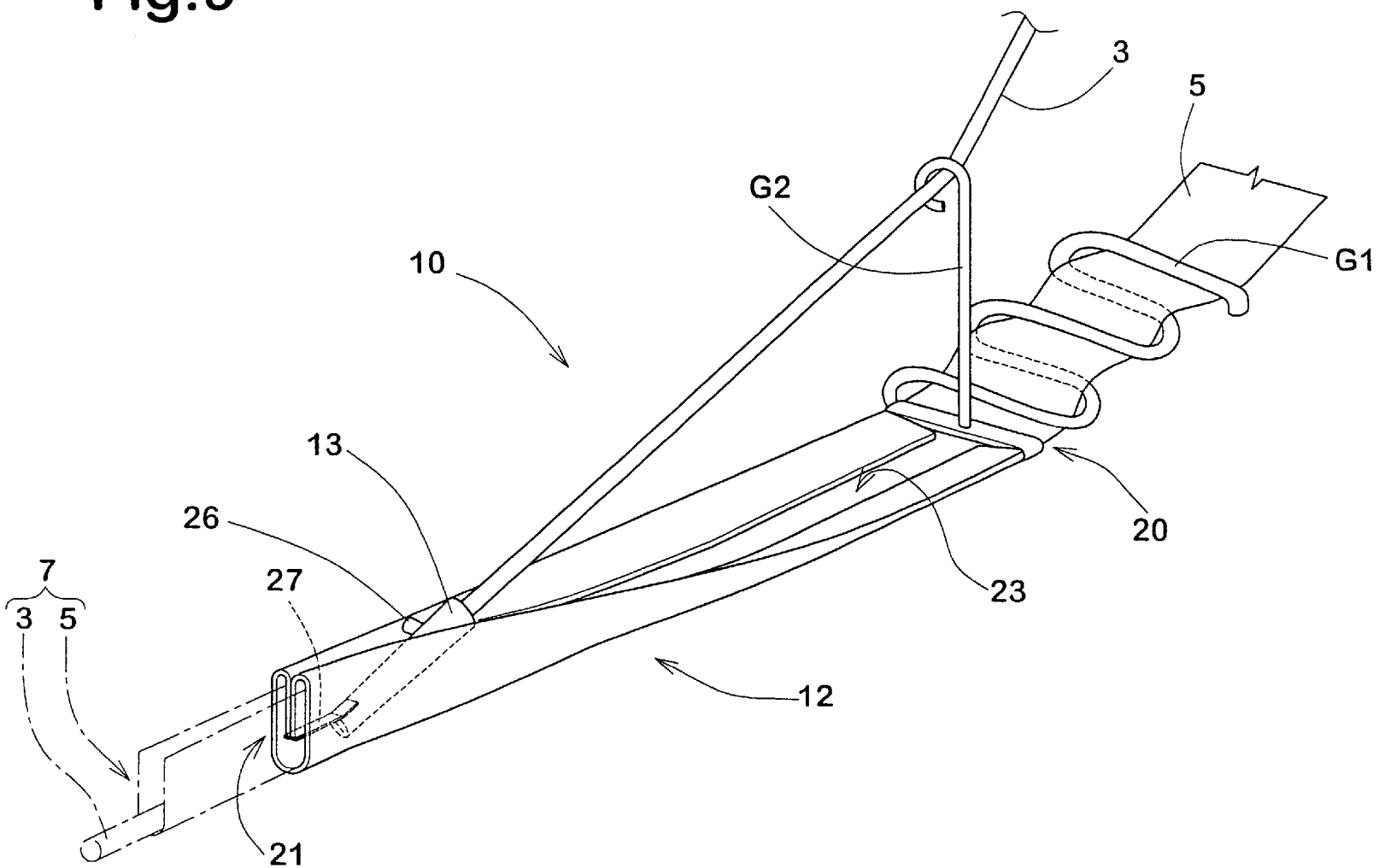
FIG. 9 is an enlarged perspective view showing one example of a containing jig.
Figure 10:
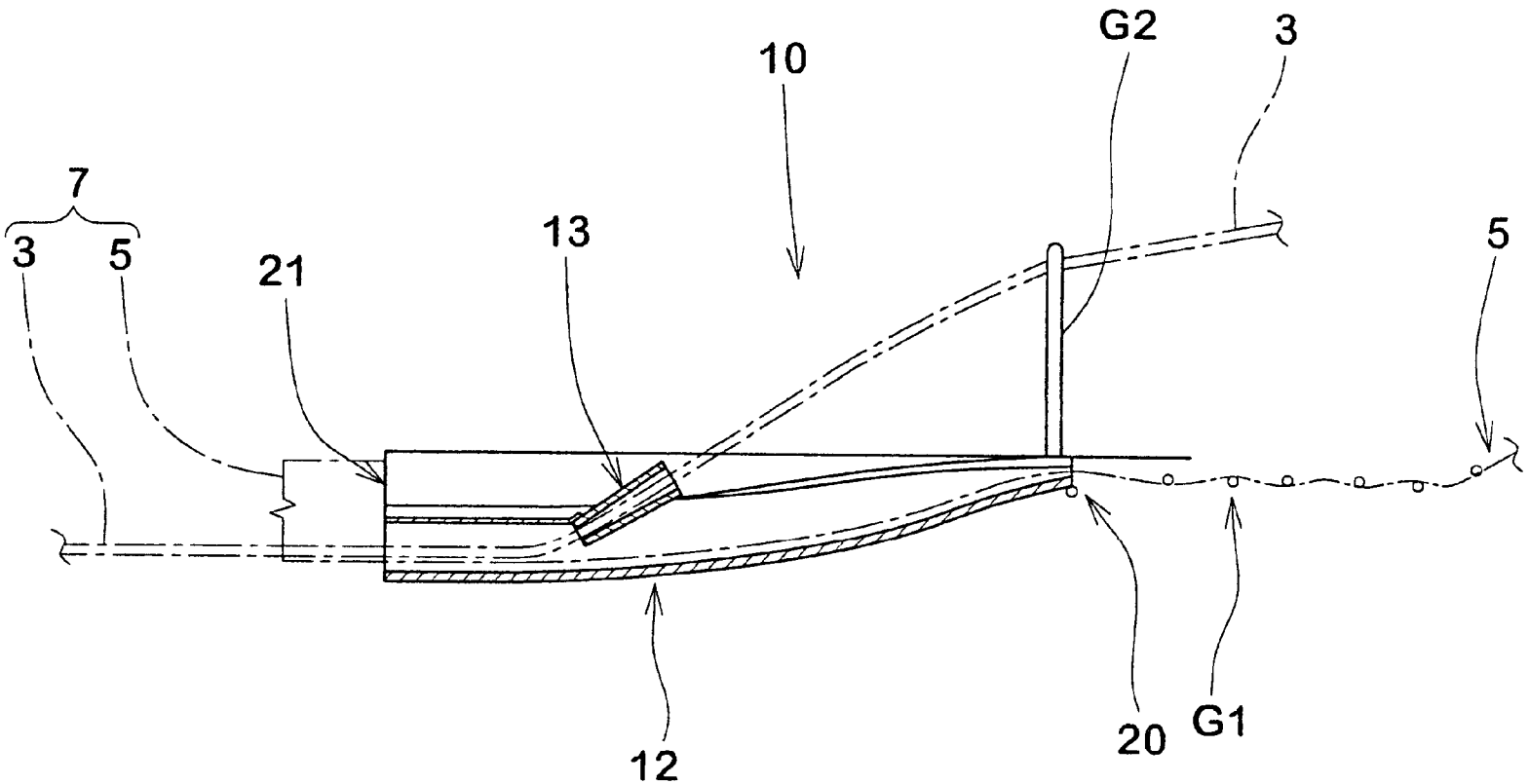
FIG. 10 is a longitudinal perspective view showing the containing jig, cut along a center line in a width direction.

The above-described supplying step can be preferably carried out by the use of, for example, a containing jig 10. The containing jig 10 includes a belt-shaped member folding guide 12 for folding the belt-shaped member 5 in two and feeding it out and a heater wire guide 13 for guiding the heater wire 3 to the belt-shaped member 5 folded in two, as shown in FIG. 9 and FIG. 10 which is a cross-sectional view along a center line in a width direction of the containing jig 10.

The belt-shaped member folding guide 12 is constituted of a cylindrical member having an insertion port 20 formed at one end thereof, into which the belt-shaped member 5 not yet folded is inserted, and a discharge port 21 formed at the other end thereof, at which the belt-shaped member fed from the insertion port 20 is folded in two and through which the folded belt-shaped member is discharged. At the insertion port 20, there is provided, for example, a guide tool G1 for preventing any misalignment in the width and vertical directions of the belt-shaped member 5.

Figure 11A:
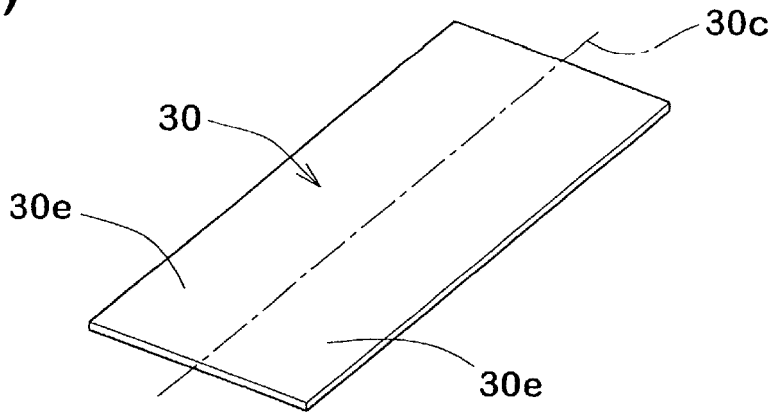
FIGS. 11A to 11C are perspective views showing one example of forming procedures of a belt-shaped folding guide.
Figure 11B:
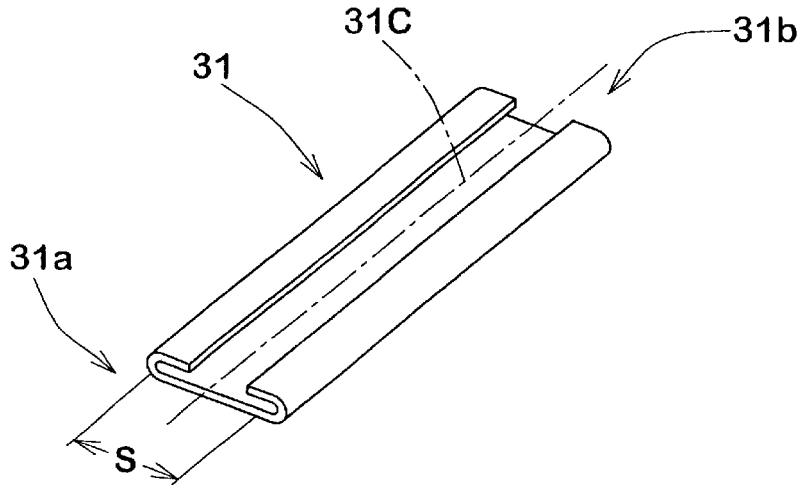

The above-described belt-shaped member folding guide 12 is formed as follows, for example: first, both side edges 30*e* and 30*e* of a metallic thin member 30 are folded toward a center line 30C in a width direction, as shown in FIG. 11A, thus forming a grooved member 31, as shown in FIG. 11B. The width S of the groove formed inside of the grooved member 31 is substantially the same as or slightly greater than the width of the belt-shaped member 5 not yet folded. Consequently, the belt-shaped member 5 can be guided.

Figure 11C:
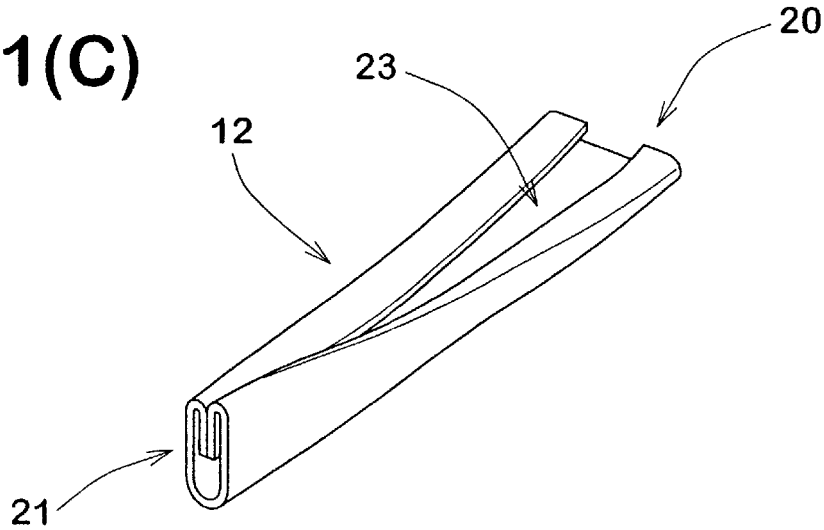

And then, only one end 31*a* of the grooved member 31 is folded in two along the center line 31C in the width direction; in the meantime, the other end 31*b* is kept in a flat state. The shape between one end 31*a* and the other end 31*b* is smoothly changed. As a consequence, as shown in FIG. 11C, the belt-shaped member folding guide 12 can be configured such that the belt-shaped member 5 can be guided from the insertion port 20 to the discharge port 21, and further, can be folded in two to be discharged from the discharge port 21. Here, since a cutout groove 23 extending in a longitudinal direction is formed at the upper surface of the belt-shaped member folding guide 12 in the present embodiment, maintenance is readily carried out by the use of the groove 23 if jamming or the like of the belt-shaped member 5 occurs.

The above-described heater wire guide 13 is formed of a pipe member, into which the heater wire 3 can be inserted, in the present embodiment, and is secured via, for example, a welding portion 26 in the vicinity of the discharge port 21 of the belt-shaped member folding guide 12. The heater wire guide 13 is disposed toward the discharge port 21 slantwise with respect to the center line 31C in the width direction, so as to guide the heater wire 3 toward the folding direction of the belt-shaped member 5. Incidentally, in the present embodiment, there is provided another guide tool G2 for separating the heater wire 3 from the belt-shaped member 5, so as to prevent any tangle between the heater wire 3 and the belt-shaped member 5.

Furthermore, in front of the heater wire guide 13, a heater wire pressing piece 27 is disposed from the heater wire guide 13 to the discharge port 21 in order to prevent the heater wire 3 from projecting from the belt-shaped member 5. Consequently, the heater wire 3 can be more securely located on the folded side of the belt-shaped member 5, folded in two. Here, the heater wire pressing piece 27 is disposed in such a manner that both side edges thereof cannot interfere with the belt-shaped member 5.

In this manner, the belt-shaped member 5 is inserted into the insertion port 20 formed at the belt-shaped member folding guide 12, and then, is drawn out of the discharge port 21. At the same time, the heater wire 3 is continuously supplied to the heater wire guide 13. Thus, the containing member 7 containing the heater wire 3 inside of the belt-shaped member 5 folded in two can be continuously supplied, as indicated by dashed lines in FIGS. 9 and 10.

As shown in FIG. 8, the above-described containing jig 10 is secured to a sewing machine body M1 of a sewing machine M via a fixing tool 11. The fixing tool 11 includes a first fixing piece 11*a* secured to the containing jig 10 and a second fixing piece 11*b* secured at one end thereof to the sewing machine body M1 while at the other end thereof to the first fixing piece 11*a*. The containing jig 10 secured to the sewing machine body M1 is adapted to dispose the discharge port 21 of the belt-shaped member folding guide 12 upstream in a feeding direction of a sewing portion M2 of the sewing machine.

Figure 12:
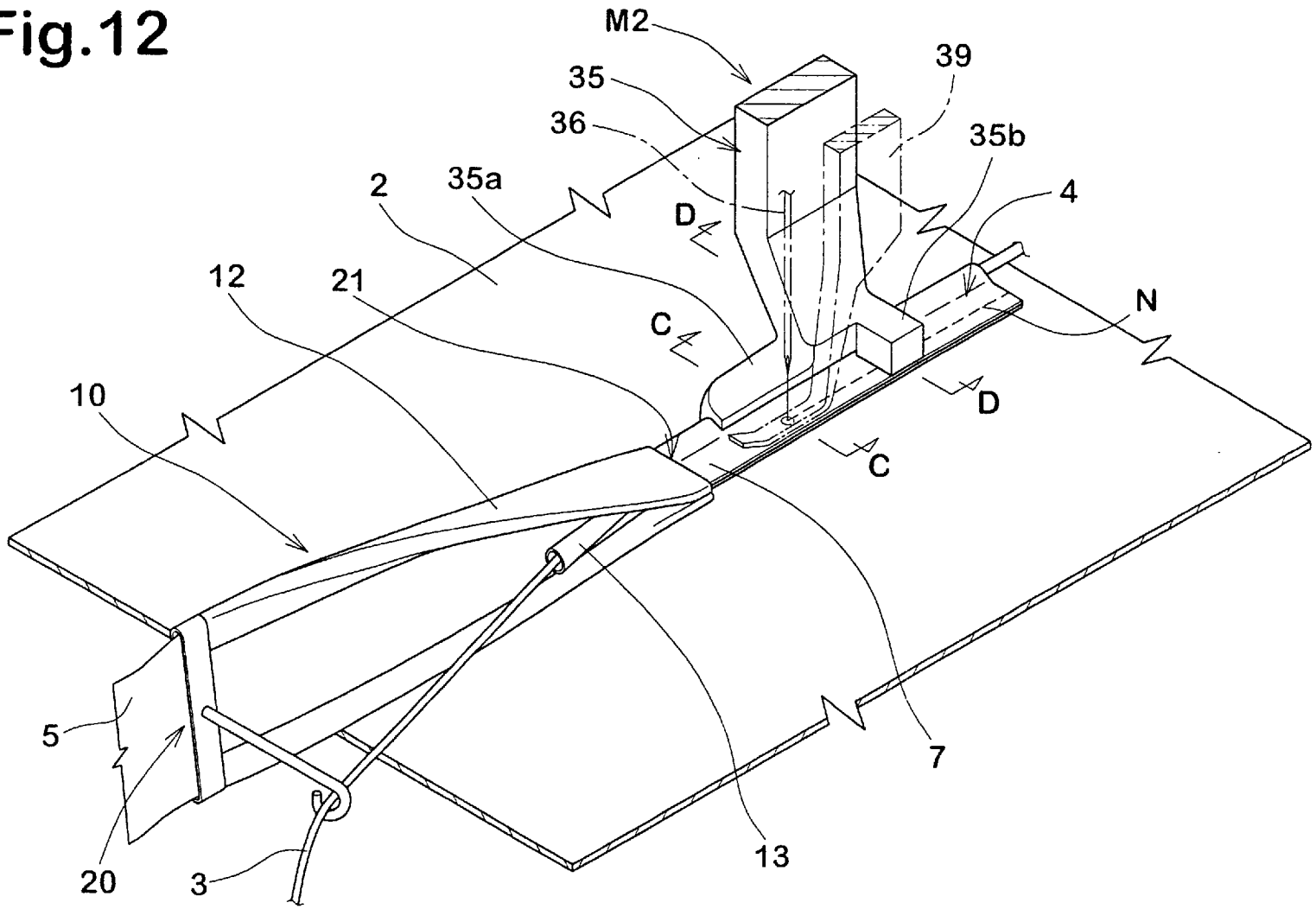
FIG. 12 is an enlarged perspective view showing the vicinity of a sewing portion of a sewing machine.
Figure 13A:
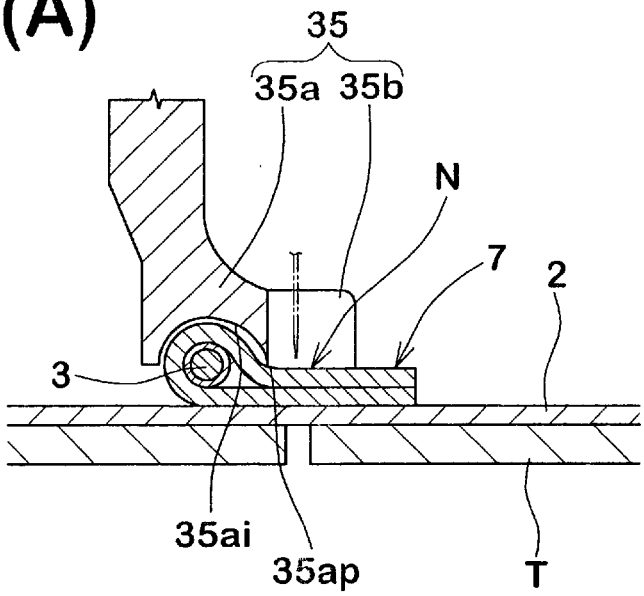
FIG. 13A is a cross-sectional view showing the sewing portion, taken along a line C—C of FIG. 12.
Figure 13B:
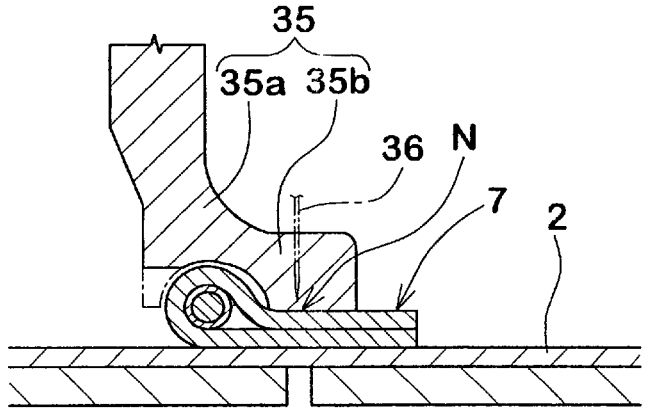
FIG. 13B is a cross-sectional view showing the sewing portion, taken along a line D—D of FIG. 12.

The sewing portion M2 of the sewing machine includes a pressing metal fitting 35 for pressing the base cloth 2 and the containing member 7 from above, and a sewing needle 36 located on one side of the pressing metal fitting 35. As shown in FIG. 12 and FIGS. 13A and 13B which are cross-sectional views taken along lines C—C and D—D of FIG. 12, respectively, the pressing metal fitting 35 includes a first presser 35*a* located above the heater wire 3 contained in the containing member 7, and a second presser 35*b* located above the side edge of the belt-shaped member 5.

The first presser 35*a* extends along the containing member 7, and further, a surface for pressing the containing member 7 includes a recessed groove 35*ai* surrounding the heater wire 3. The first presser 35*a* also comprises a pressing part 35*ap* for pressing between a sewing section N for sewing the containing member 7 to the base cloth 2 and the heater wire 3 contained in the containing member 7. This pressing part 35*ap* and the recessed groove 35*ai* can prevent misalignment of the containing member 7 in the width direction, and further, serves to accurately feed out the containing member 7 in the longitudinal direction. The second presser 35*b* in the present embodiment is formed into a small and short block, which is located downstream of the sewing needle 36. Moreover, the second presser 35*b* can press between the heater wire 3 and a sewing section N, at which the containing member 7 is seamed together with the base cloth 2. Consequently, it is possible to prevent the movement of the heater wire 3 toward the sewing section N, so as to improve the efficiency of a sewing work. Here, reference numeral 39 in FIG. 12 designates a sewing needle guide.

Figure 14:
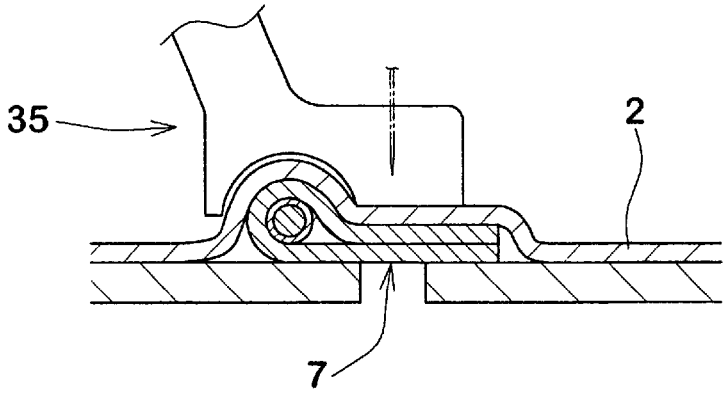
FIG. 14 is a partial cross-sectional view showing another mode of a sewing step.

As shown in FIGS. 13A and 13B, the containing member 7 is continuously supplied onto the base cloth 2, and at the same time, the containing member 7 and the base cloth 2 are sewn integrally with each other by the sewing needle 36 while they are fed, so that the containing member 7 containing the heater wire 3 therein can be continuously sewn to the base cloth 2. At this time, it is desirable from the viewpoint of the improvement of working efficiency that a marking P indicating a sewing position should be printed or the like on the base cloth 2 so as to confirm a sewing position, as shown in FIGS. 7 and 8. Various patterns such as a solid line and a broken line can be used as the marking P. Since the containing member 7 is fed out in a predetermined direction all the time by a feeder, not shown, disposed on the side of the sewing machine in the present embodiment, the base cloth 2 can be variably positioned with respect to the containing member 7 by rotating the base cloth 2 on the sewing needle 36. In this manner, the containing member 7 can be sewn to the base cloth 2 in a meandering shape. Incidentally, the containing jig 10, for example, is attached onto the side of a sewing table T, so that the base cloth 2 and the containing member 7 can be sewn integrally with each other in the state in which the base cloth 2 is placed on the containing member 7, as shown in FIG. 14.

As described above, the belt-shaped member 5 is folded in two, and at the same time, the heater wire 3 is contained in the belt-shaped member 5. Furthermore, the belt-shaped member 5 is continuously sewn to the base cloth 2, thereby making it unnecessary to insert the heater wire into the space, unlike in the prior art. This can remarkably shorten a production time, thus contributing to the improvement in productivity.

Figure 15:
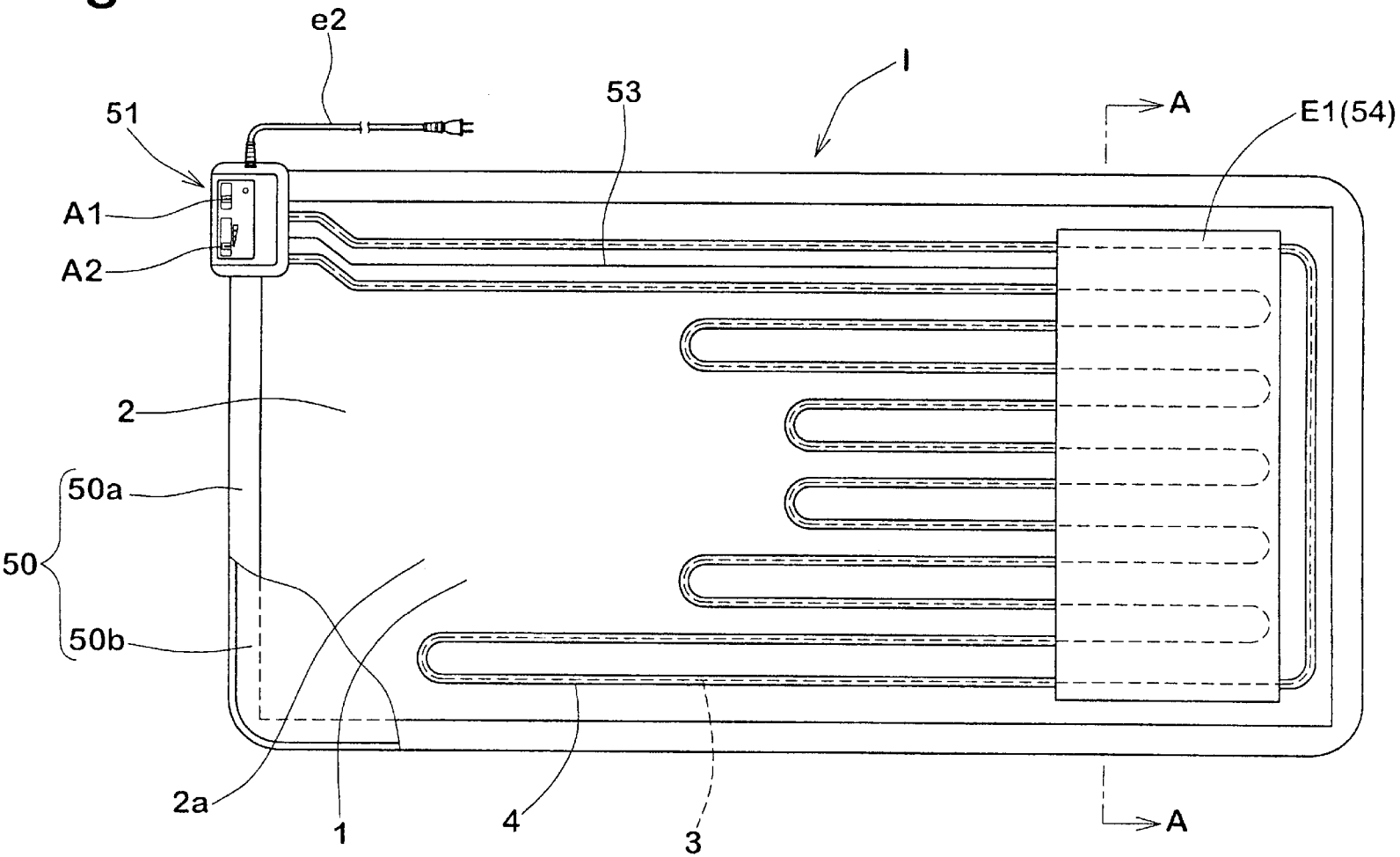
FIG. 15 is a plan view showing an electric potential mat using the sheet member with a heater wire in the present embodiment.
Figure 16:
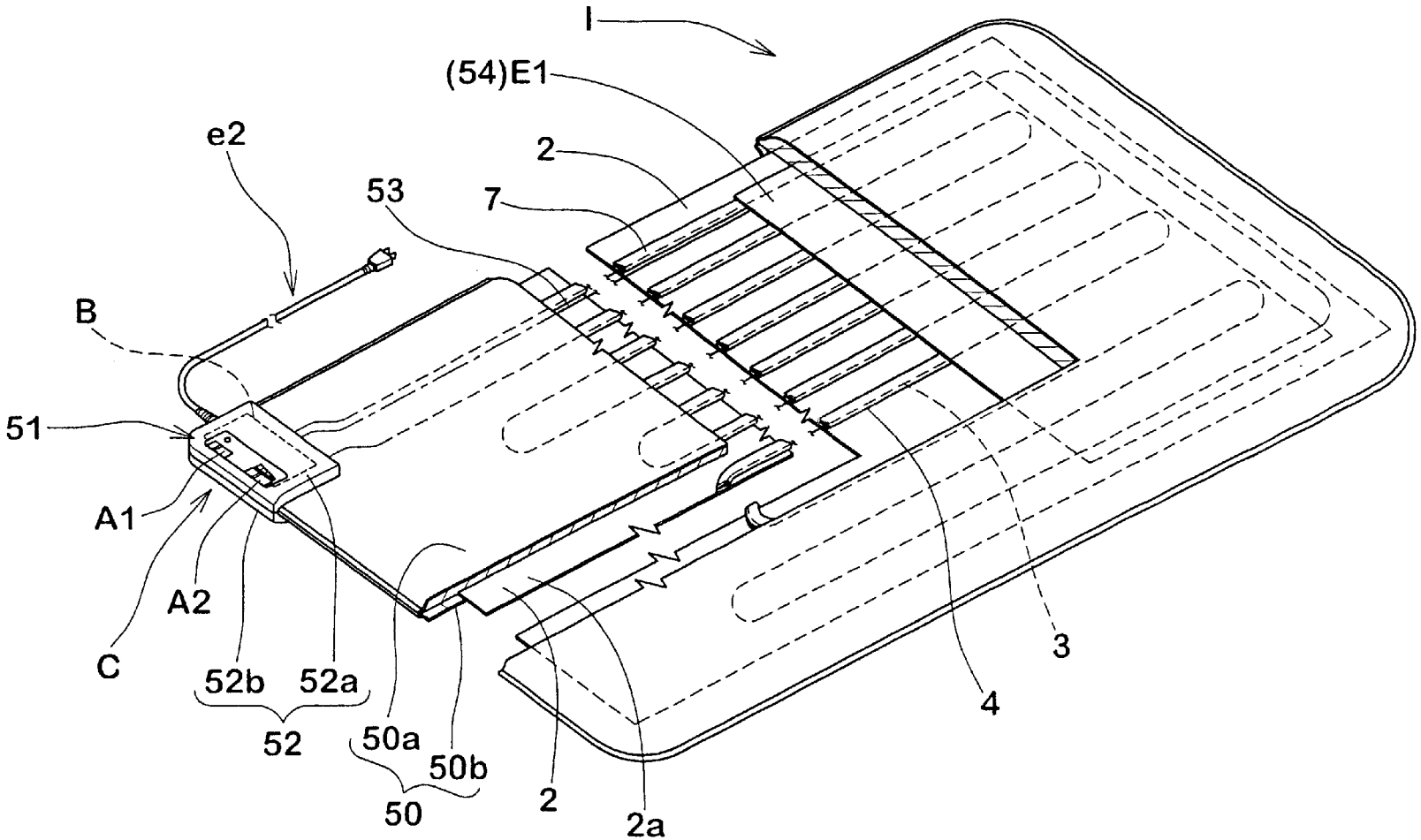
FIG. 16 is a perspective view showing the electric potential mat in the present embodiment.
Figure 17:
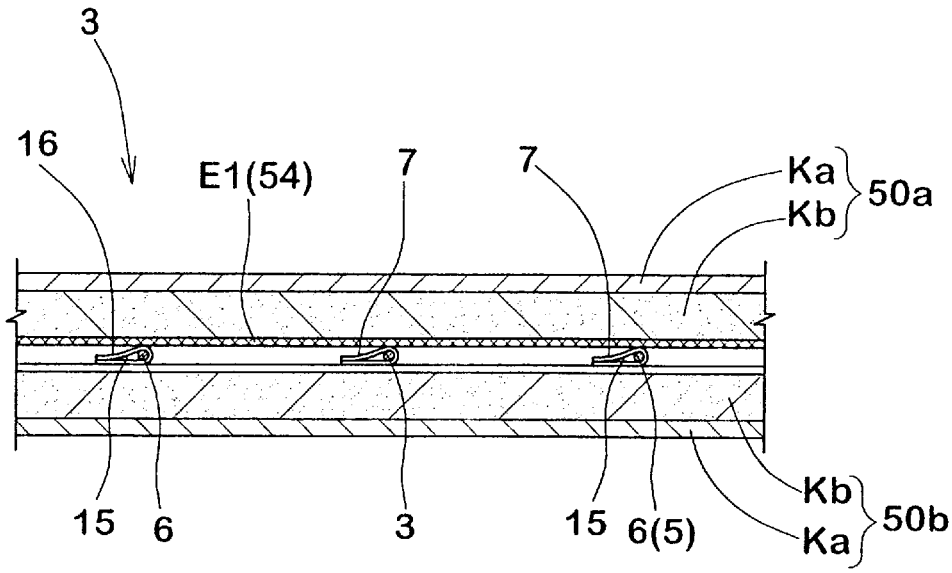
FIG. 17 is a partial cross-sectional view showing the electric potential mat, taken along a line A—A of FIG. 15.

FIGS. 15 and 16 illustrate an electric potential mat "I" using the above-described sheet member 1 with the heater wire. FIG. 17 shows a cross section taken along a line A—A of FIG. 15. The electric potential mat "I" comprises a mat body 50 and a controller 51 fixed integrally at a corner portion C of the mat body 50. The mat body 50 contains the above-described sheet member 1 with the heater wire and an electric potential generator E1 placed on the sheet member 1 therein in the present embodiment. Here, in the electric potential mat "I" in the present embodiment, only a power cord e2 projects outside of the controller 51.

As shown in FIG. 17, the mat body 50 is constituted of an upper cushion member 50*a* and a lower cushion member 50*b*. Each of the upper and lower cushion members 50*a* and 50*b* is preferably formed of a quilting member obtained by integrally sewing a buffer member Kb such as polyester cotton or sponge inside of an elemental material Ka, for example. The peripheral portion of the mat body 50 is integrally seamed by sewing together and/or using a fastener, not shown. The mat body 50 in the present embodiment can be used as one of bedclothes, and additionally, can be embodied in various modes: for example, a small mat such as a wrap or a cushion stretched over a seat of a chair.

The electric potential generator E1 consists of a sheet-like energizing cloth 54 in the present embodiment, and is disposed in the vicinity of the footing of the mat body 50. The energizing cloth 54 is configured by including a flexible non-woven fabric made of a conducive material such as aluminum or carbon or a sheet piece made of a metal netting or the like. To the electric potential generator E1 is applied a minus high voltage (for example, about −450 V to −500 V) from an electric potential control circuit, described later, via an electrode wire 53. Consequently, the minus high voltage is charged from the energizing cloth 54 to a human body insulated from the ground lying on the mat body 50, so that an ionization quantity of sodium or calcium contained in circulating blood is increased, thereby alkalifying an acidified human body so as to improve immunity. In Japan, the medical effect of the above-described electric potential mat is appreciated, and therefore, the electric potential mat is prevailed as ion treatment equipment. Incidentally, a quantity of current flowing in the human body is very small, and thus, electric safeness with respect to the human body can be secured.

Figure 18:
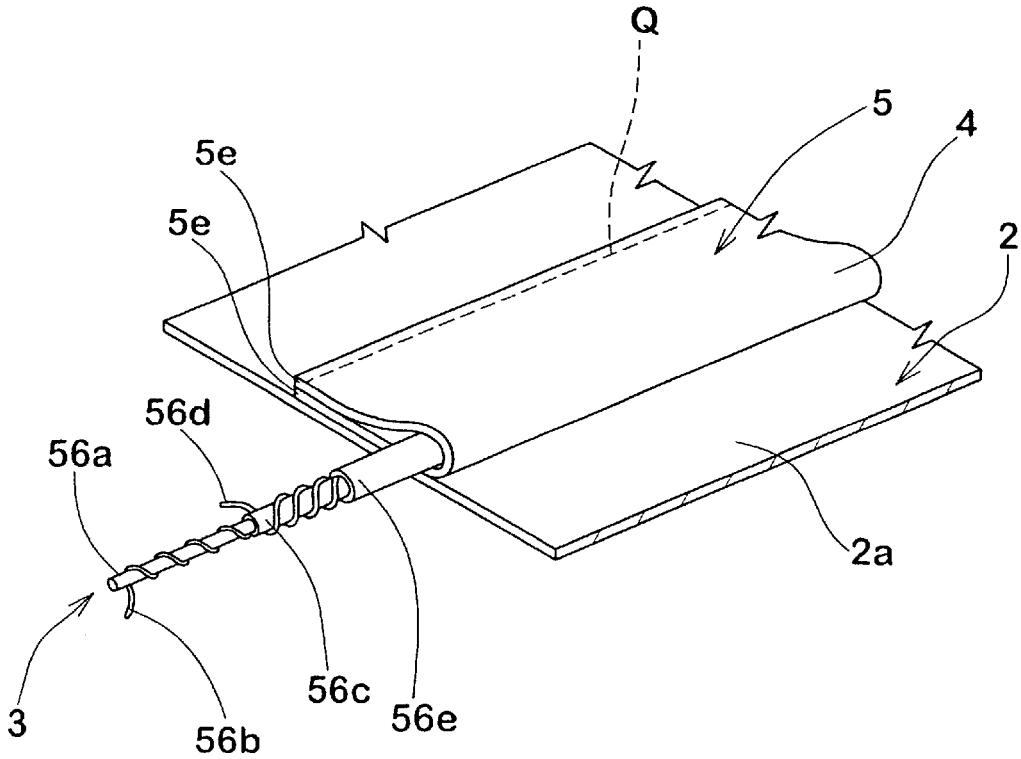
FIG. 18 is a partial perspective view showing another example of a heater wire.

As shown in FIG. 18, the heater wire 3 in the present embodiment is constituted of a core member 56*a* made of a resin material, a heat generating wire 56*b* spirally wound around the core member 56*a*, a resin insulating layer 56*c* made of, for example, nylon, covering the outside of the heat generating wire 56*b*, a thermo-sensitive wire 56*d* spirally wound around the resin insulating layer 56*c*, and a cover layer 56*e* covering the outside of the thermo-sensitive wire 56*d*.

The heat generating wire 56*b* is made of, for example, Nickel alloy. An energization quantity of the heat generating wire 56*b* is controlled by a heater control circuit, described later, and thus, the heat generating wire 56*b* generates heat at a predetermined temperature. The thermo-sensitive wire 56*d* also is connected to the heater control circuit. The thermo-sensitive wire 56*d* is varied in its own resistance according to the temperature of the heat generating wire 56*b*. As a consequence, the heater control circuit can control the temperature of the heater wire 3 by the use of the thermo-sensitive wire 56*d*. Here, the method for fixing the heater wire 3 has been already described above.

The controller 51 includes a cover member 52 made of a resin, a control substrate B incorporated in the cover member 52 and switches A1 and A2 disposed in the cover member 52, as shown in FIG. 16. The controller 51 is integrally attached at the corner portion C of the mat body 50 in the present embodiment. Although the corner portion C is any one of four corner portions in the case where the mat is formed into a rectangular shape, it is desirable that the corner portion C should be either one of right and left corner portions on the side of a head of a user in a use state in order to improve operability when he or she sleeps. Furthermore, the above-described "integral attachment" signifies that the controller 51 is attached to the mat body 50 in such a manner that the mutual positional relationship between the controller 51 and the mat body 50 is never changed.

The mat body 50 is held between an upper cover member 52*a* and a lower cover member 52*b*, so that the cover member 52 is fixed at the corner portion C via a screw, as shown in FIG. 16. Furthermore, the slidable switches A1 and A2 in the present embodiment are disposed in the upper cover member 52*a*. However, the configuration is not limited to the above-described configuration.

Figure 19:
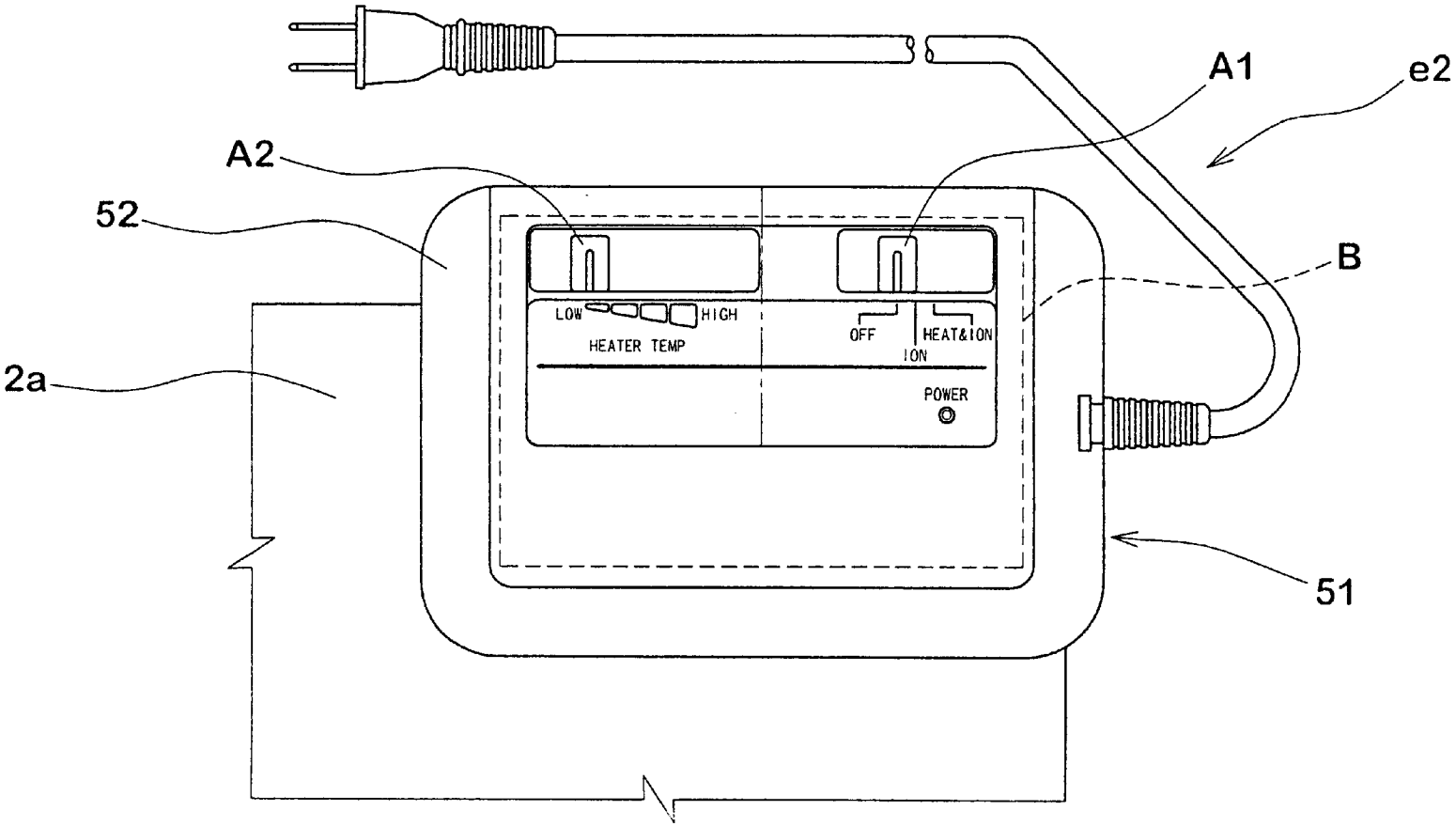
FIG. 19 is an enlarged plan view showing a controller.

The switch A1 is slidably operated at a stop position indicating "OFF", at a position indicating "ION" at which only an electric potential is emitted, and at a position indicating "HEAT & ION" at which an electric potential is emitted and a heater is driven, as shown in FIG. 19. With these operations, the switch A1 actuates the electric potential control circuit so as to emit the electric potential, and further, can turn on or off the heater control circuit. In contrast, the switch A2 is slidably between positions "LOW" and "HIGH" in the present embodiment, so that a volume VR (shown in FIG. 20), disposed in the heater control circuit is continuously adjusted, thereby adjusting the temperature of a heater wire 3.

Figure 20:
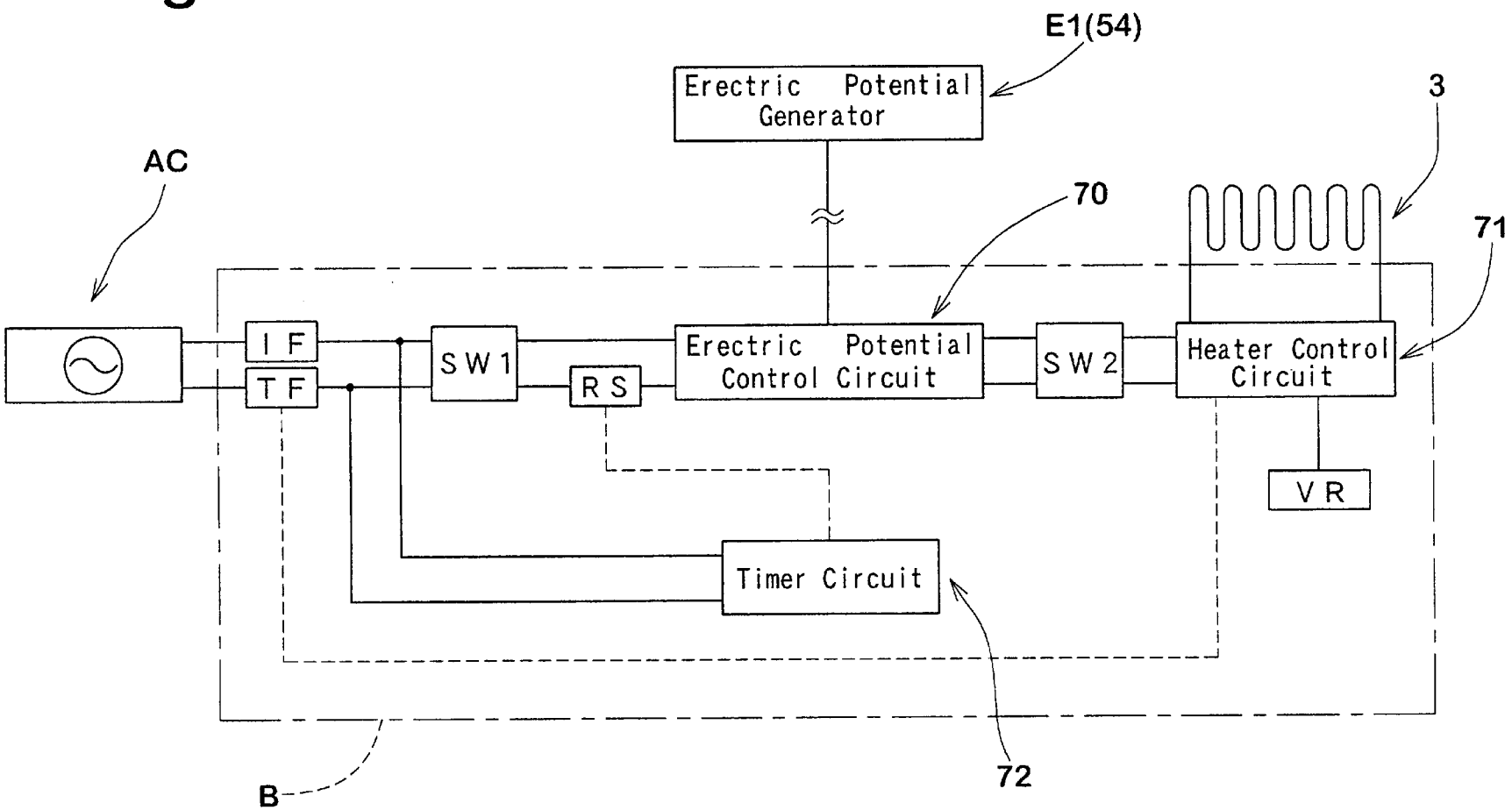
FIG. 20 is a block diagram illustrating one example of a control substrate.

FIG. 20 is a block diagram illustrating one example of the control substrate B incorporated in the cover member 52. In the present embodiment, the control substrate B includes an electric potential control circuit 70 for applying a minus high electric potential to the electric potential generator E1, a heater control circuit 71 for controlling the heater wire 3 and a timer circuit 72 capable of limiting the operation time of the electric potential control circuit 70 and/or the heater control circuit 71.

The electric potential control circuit 70 is connected to a commercial power source AC via a current fuse IF, a temperature fuse TF, a switch SW1 and a relay junction RS. Moreover, the heater control circuit 71 is connected in series to the electric potential control circuit 70 with respect to the commercial power source AC. Additionally, another switch SW2 is interposed between the heater control circuit 71 and the electric potential control circuit 70.

Each of the switches SW1 and SW2 is brought out of contact by turning off the switch A1 in a controller section 51, thereby shutting off power supply to the electric potential control circuit 70 and the heater control circuit 71. Furthermore, when the switch A1 is switched to the position indicating "ION", the switch SW1 is brought into contact, so that the commercial power source supplies the power to the electric potential control circuit 70. Consequently, the minus high voltage is applied to the electric potential generator E1. The electric potential control circuit 70 consists of, for example, a double voltage rectifying circuit or the like, for increasing a maximum voltage of the commercial power source (141 Volt in Japan) up to an integral multiple thereof. And then, the voltage is allowed to act on the electric potential generator E1 at, for example, about minus 300 Volt to minus 500 Volt, more preferably, about minus 340 Volt to minus 400 Volt via a safety protect resistance or the like.

Moreover, when the switch A1 is switched to the position indicating "HEAT & ION", the switches SW1 and SW2 are brought into contact, thereby energizing also the heater control circuit 71. The heater control circuit 71 can apply a predetermined current to the heater wire 3 upon the energization. Additionally, the volume VR is actuated by the switch A2, and accordingly, the current volume to the heater wire 3 can be adjusted, and further, the temperature can be adjusted.

The timer circuit 72 is constituted of an IC circuit or the like for counting a time during which the switch SW1 is kept on contact. The timer circuit in the present embodiment outputs a signal in such a manner as to open the relay junction RS when it was counted 8 hours. In this manner, the continuous use of each of the electric potential emission and the heater driving in the electric potential mat "I" is limited to 8 hours to the maximum. This can serve in preventing any waste of electric power, overheating or the like even if the switch is forgotten to be turned off. In the case where the heat generating wire 56*b* is abnormally overheated due to any factor, the heater control circuit 71 is equipped with a safety function, by which the thermo-sensitive wire 56*d* detects the abnormality so that the temperature fuse TF is melted down.

Incidentally, the above-described arrangement of the control substrate B is merely one example. Therefore, the setting value of the electric potential in the electric potential control circuit 70 can be varied according to objects, or can be adjusted by the user. Additionally, the heater control circuit 71, the timer circuit 72 or the like may be constituted by using a microcomputer or the like or by adopting other well known arrangements. Namely, the present invention can be carried out in various modes.

The above-described electric potential mat "I" applies the minus high voltage electric potential to the human body lying on the mat body 50 when someone is sleeping on it, for example. When the heater wire 3 also is driven, the electric potential mat "I" serves in promoting the blood circulation in the human body. These functions can be utilized singly or in combination, as required. Furthermore, the controller having the switch A1 is integrally disposed at the corner portion C of the mat body 50 in the electric potential mat "I", thereby achieving excellent operability. Moreover, controller disposed apart from the mat body is not necessary, unlike in the prior art, thus reducing the manufacturing cost and remarkably improving the usability.

In this manner, according to the present invention, it is possible to provide the sheet member with the heater wire, in which the structure can be simplified and the productivity can be improved. Furthermore, according to the fabricating method, the productivity of the sheet member with the heater wire can be improved and can be fabricated at a reduced cost. Moreover, according to the present invention, it is possible to provide the inexpensive electric potential mat by the use of the above-described sheet member with the heater wire.

What is claimed is:

1. A sheet member with a heater wire comprising:

a sheet-like base cloth; and a cylindrical containing portion containing the heater wire therein and attached at one surface of the base cloth in a meandering shape, said containing portion being formed by folding a belt-shaped member in two along an axial line in its longitudinal direction.

2. A sheet member with a heater wire of claim 1, wherein the folding of the belt-shaped member allows both side edges thereof to face to each other, said belt-shaped member being attached in the vicinities of the side edges facing each other, with the base cloth.

3. A sheet member with a heater wire of claim 1, wherein the base cloth has a marking along the attaching position of the containing portion.

4. An electric potential mat comprising a mat body containing:

an electric potential generator for applying high voltage minus electric potential to a human body insulated from the ground lying thereon; and a sheet member with a heater wire comprising a sheet-like base cloth, and a cylindrical containing portion containing the heater wire therein and attached at one surface of the base cloth in a meandering shape wherein said containing portion is formed by folding a belt-shaped member in two along an axial line in its longitudinal direction.

5. An electric potential mat of claim 4, wherein the mat body is integrally provided with a controller section including an electric potential control circuit for controlling the electric potential generator and a on-off switch for operating the electric potential control circuit so as to switch electric potential emission.

6. An electric potential mat of claim 5, wherein the controller section includes a heater control circuit capable of controlling the heat generation by the heater wire, and a switch for operating the heater control circuit.

7. A method for fabricating a sheet member with a heater wire comprising the steps of:

continuously supplying a containing member containing the heater wire therein; and sewing the supplied containing member to one surface of a sheet-like base cloth in a meandering shape, wherein the containing member contains a heater wire therein by folding a belt-shaped member in two along an axial line in its longitudinal direction.

8. A method for fabricating a sheet member with a heater wire of claim 7, wherein the containing member is continuously supplied in the supplying step by using a containing jig having a belt-shaped member folding guide for folding the belt-shaped member in two as the belt-shaped member passes and a heater wire guide for guiding the heater wire in such a manner that the heater wire can be contained in the belt-shaped member folded in two.

9. A method for fabricating a sheet member with a heater wire of any of claim 7, wherein the sewing step is carried out by a sewing machine having a pressing metal fitting for pressing between a sewing section for sewing the containing member to the base cloth and the heater wire contained in the containing member, so as to prevent a movement of the heater wire toward the sewing section.

10. A method for fabricating a sheet member with a heater wire of any of claim 7, wherein the containing member is sewn in accordance with a marking previously formed at a containing member attaching position of the base cloth in the sewing step.

* * * * *